US005823851A

United States Patent [19]

Dicker

[11] Patent Number: 5,823,851

[45] Date of Patent: Oct. 20, 1998

[54] BRA SPORT TOP

[76] Inventor: Timothy P. Dicker, 11359 Dornfield, Lake View Ter., Calif. 91342

[21] Appl. No.: 636,147

[22] Filed: Apr. 22, 1996

[51] Int. Cl.[6] ..... A41C 3/00; A41C 3/12

[52] U.S. Cl. ..... 450/2; 450/8; 450/19; 450/64; 450/74; 450/86; 2/73

[58] Field of Search ..... 2/67, 73, 44, 45, 2/326, 327, 328, 329, 330, 331, 332, 333, 334, 105, 106; 450/2, 1, 8, 12, 19, 20, 21, 23, 26, 62, 64, 74, 75, 76, 79, 80, 86; 602/19

[56] References Cited

U.S. PATENT DOCUMENTS

| | | | |
|---|---|---|---|
| 137,724 | 4/1873 | Russell . | |
| 623,413 | 4/1899 | Murray . | |
| 1,110,305 | 9/1914 | Lipton | 2/110 |
| 1,129,515 | 2/1915 | Perry | 2/45 X |
| 1,167,992 | 1/1916 | Guggenheim | 450/58 X |
| 1,510,428 | 9/1924 | Voliva . | |
| 1,667,796 | 5/1928 | Morrison . | |
| 2,701,362 | 2/1955 | Lo Cascio | 2/42 |
| 2,768,381 | 10/1956 | Harris | 450/12 |
| 2,863,460 | 12/1958 | Monroe | 128/435 |
| 2,915,067 | 12/1959 | Bracht | 128/469 |
| 3,030,961 | 4/1962 | Erteszek | 128/465 |
| 3,163,167 | 12/1964 | Chisholm | 128/477 |
| 3,465,754 | 9/1969 | Lockwood et al. | 128/425 |
| 4,453,549 | 6/1984 | DiTullio | 128/498 |
| 4,632,118 | 12/1986 | Garutso | 128/477 |
| 4,741,719 | 5/1988 | Wirth | 450/30 |
| 4,781,651 | 11/1988 | Ekins | 450/79 |
| 4,816,005 | 3/1989 | Braaten | 450/58 |
| 5,167,566 | 12/1992 | Novitsky et al. | 450/74 |
| 5,244,432 | 9/1993 | Moy Au et al. | 450/54 |

*Primary Examiner*—Jeanette E. Chapman
*Attorney, Agent, or Firm*—Connolly & Hutz

[57] ABSTRACT

A bra sport top provides enhanced posture and increased breast support for women engaging in athletic activities. Over-shoulder harnesses encircle each shoulder and serve to urge them back. Cross braces interconnect the two over-shoulder harnesses in a crosswise manner between the shoulder blades. A support belt traveling through a slip sleeve encircles the wearer's torso below the breast and shoulder blades. Interconnecting the over-shoulder harnesses and the slip sleeve are breast-tensioning panels that compress and restrain the breasts so as to prevent any damage to the breast tissue. The left and right breast-tensioning panels may be interconnected by a detachable coupling means or may be connected by elastic bands or the like. Alternative embodiments allow for different directional support of the underlying breast tissue by the breast-tensioning panels.

18 Claims, 2 Drawing Sheets

BRA SPORT TOP

BACKGROUND OF THE INVENTION

1. Field of the Invention

This invention relates to athletic clothing and, more particularly, to a sport top for a woman that enhances her posture and provides breast support.

2. Description of the Related Art

Several attempts have previously been made to provide breast and back support for women. Such support is desirable as enhanced posture allows for better physical functioning of the human body and prevents damage that might otherwise afflict the breasts.

A lack of skeletal support for women's breasts allow them to bounce, causing sudden and abrupt collisions with the chest. These collisions may bruise and/or otherwise strain the breast tissues, causing damage that may be permanent. While such stresses may be distributed over the entire breast as a whole, repeated collisions serve to cumulatively bruise and damage the breast tissue. Such collisions often occur during exercise such as aerobics or jogging. As physical exercise is most physically helpful and healthful when performed several times a week, it is best to prevent any physical injury from happening, at least to the greatest extent possible.

Concerns with respect to breast-tissue trauma from vigorous physical exercise may be held by those women who are large breasted, or well endowed. The damage or injury that might otherwise not afflict the breast tissue may give such women pause before engaging in vigorous physical exercise.

In the past, attempts have been made to address the aforementioned problems of back and breast support. Generally, the prior art has not focused well upon these dual purposes. More often, the prior art addresses cosmetic breast support, as a foundation for other clothing, or addresses the protection of the breasts from impact during exercise or sports, such as soccer. Some of the related art is set forth in the brief descriptions below.

L. Lockwood, et al,. U.S. Pat. No. 3,465,754

This reference is directed to a brassiere which does not have any front connection between the brassiere cups. Referring to FIG. 4, the brassiere is supported by a pair of arm members 24R, 22R and a pair of cross-members 30, 32. However, there is no disclosure of a belt member in combination. Further, there is no disclosure of the brassiere cups 26 and 28 having any types of spokes.

M. N. Moy Au. et al., U.S. Pat. No. 5,244,432

This reference is directed to a sports-type brassiere having protective inserts. As shown in FIG. 6, the brassiere includes a pair of cross-strap members 19 which extend between the respective cups and a belt member.

C. Wirth, U.S. Pat. No. 4,741,719

This reference is directed to a garment having breast supports for use during athletic activities. As shown in FIG. 7, the garment includes a pair of arm members defined by the shoulder straps 14*a,* 14*b,* a pair of cross members defined by the tendons 32*a'* and 32*b',* and a belt 34.

R. Braaten, U.S. Pat. No. 4,816,005

This reference is directed to a sports bra adapted to provide for support of the breasts and back of the wearer. As best seen in FIGS. 3 and 4, the sports bra 10 is provided with a pair of arm members 60, a pair of cross members 50 and 52, and a belt member 22 on the back of the device.

With respect to the structure of bra cups, U.S. Pat. Nos. 2,915,067 and 3,163,167 disclose cup structures having vertically directed "spokes" for supporting the breasts. U.S. Pat. Nos. 4,632,118, 4,453,549, 5,167,566, and 2,701,362 disclose cup structures having radially directed "spokes" for supporting the breasts.

From the above, it can be seen that the prior art has not well addressed the concerns of athletic women regarding support for the back and breasts. Attaining such support in an athletic sport top for women would provide greater enjoyment of sports and other activities while reducing injury and enhancing the healthful nature of such activity through better posture.

SUMMARY OF THE INVENTION

The present invention resides in a bra sport top that provides several means by which back and breast support are created and maintained.

Two shoulder harnesses serve to pull the woman's shoulders back. One shoulder harness encircles each of the woman's shoulders. Cross braces interconnect the two shoulder harnesses to further pull the woman's shoulders back. A support belt encircles the woman's midriff just below her breasts and shoulder blades. Intermediating the space between the shoulder harnesses and the support belt are left and right breast-restraining means that cover and restrain the respective left and right breasts of the woman. Buckles, clasps, hooks and eyes, or other means serve to connect the left and right breast-restraining means. A slip sleeve present below the breast-restraining means serves to allow the slideable articulation of the support belt so that there is some degree of freedom between the breast-restraining means and the support belt.

In alternative embodiments, bands or strips of material can be used to provide directional support to the underlying breasts. These strips may be centered upon the woman's sternum, at a point below each breast, or may be vertically striated.

To enhance the adjustability of the present invention, the cross braces may be made adjustable so as to allow the tension upon the cross braces and the attached shoulder harnesses to be adjustable according to the wearer's preferences.

OBJECTS OF THE INVENTION

It is an object of the present invention to provide better back support for women engaged in athletic activity.

It is another object of the present invention to provide a resilient breast support for women engaged in athletic activity.

It is yet another object of the present invention to provide simultaneous back and breast support for women engaged in athletic activities.

It is an additional object of the present invention to provide breast and back support for women engaged in athletic activities by means of a bra sport top that can flexibly and resiliently provide support to a woman's upper torso during strenuous exercise.

These and other objects and advantages of the present invention will be apparent from a review of the following specification and accompanying drawings.

DESCRIPTION OF THE PREFERRED EMBODIMENTS

The bra sport top 10 of the present invention provides enhanced posture and increased breast support for the athletic woman wearer W. By pulling the shoulders back and by resiliently restraining the breasts, the bra sport top 10 of the present invention allows women to engage in vigorous physical activity while maintaining good posture and protecting their breasts from collateral damage.

The bra sport top 10 has a pair of over-shoulder harnesses 12, 14. The left over-shoulder harness 12 encircles the left shoulder while the right over-shoulder harness 14 encircles the right shoulder. These two over-shoulder harnesses serve to establish a foundation upon which a breast and back support may be established. The over-shoulder harnesses fit snugly about the shoulders without constricting, gathering, or pinching and allow free movement of the arms.

Figure 1:
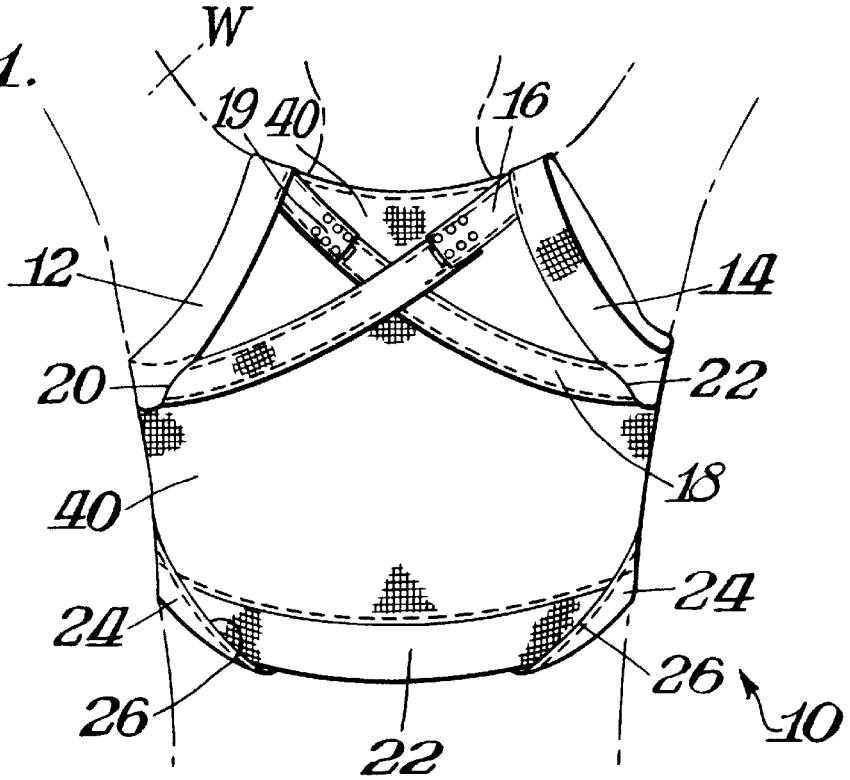
FIG. 1 shows a rear elevational view of a first embodiment of the bra sport top of the present invention. The wearer is shown in phantom. Stitching is indicated by the dashed lines.

At the back of the bra sport top 10, as shown in FIG. 1, is a pair of cross braces 16, 18. The cross brace 16 attached at the top of the right shoulder harness is designated as the right cross brace 16. The other cross brace 18 that attaches to the top of the left over-shoulder harness 12 is designated the left cross brace 18. The right cross brace 16 is attached at the top of the right over-shoulder harness 14 and descends between the shoulder blades of the woman wearer W to the lower portion of the left over-shoulder harness 12. At the connection 20 between the right cross brace 16 and left over-shoulder harness 12, the right cross brace 16 merges with the left over-shoulder harness 12. The same is similarly true for the left cross brace 18. The left cross brace 18 is attached to the top of the left over-shoulder harness 12 and traverses the back of the woman wearer W between the shoulder blades to connect and merge with the right over-shoulder harness at the connection between them 22.

Individually, the two over-shoulder harnesses serve to restrict the forward articulation of the individual's shoulders. As connected by the cross braces 18, 20, the over-shoulder harnesses 12, 14 serve to pull both shoulders back and somewhat toward each other across the spine thereby pulling the shoulders back farther.

The right and left cross braces 16, 18 may be adjustable so that the tension exerted by them can be selectively altered. FIG. I shows one such embodiment where hooks and eyes 19 are used to allow adjustment of the cross braces 16, 18. By such adjustability of the cross braces 16, 18, the wearer W can achieve a most comfortable but effective tension.

At the bottom of FIG. 1, the support belt 22 is shown partially encircling the wearer W below the shoulder blades. The support belt 22 is generally made of elastic material that can endure the rigors of vigorous exercise.

One or more slip sleeves 24 surround the support belt 22 as the support belt 22 travels from the back of the wearer W to the front. The slip sleeve 24 may have an angled edge 26 into which the support belt 22 travels. The angled edge prevents any catching of the support belt on the slip sleeve 24 as it stretches and moves about or within the slip sleeve 24.

Figure 2:
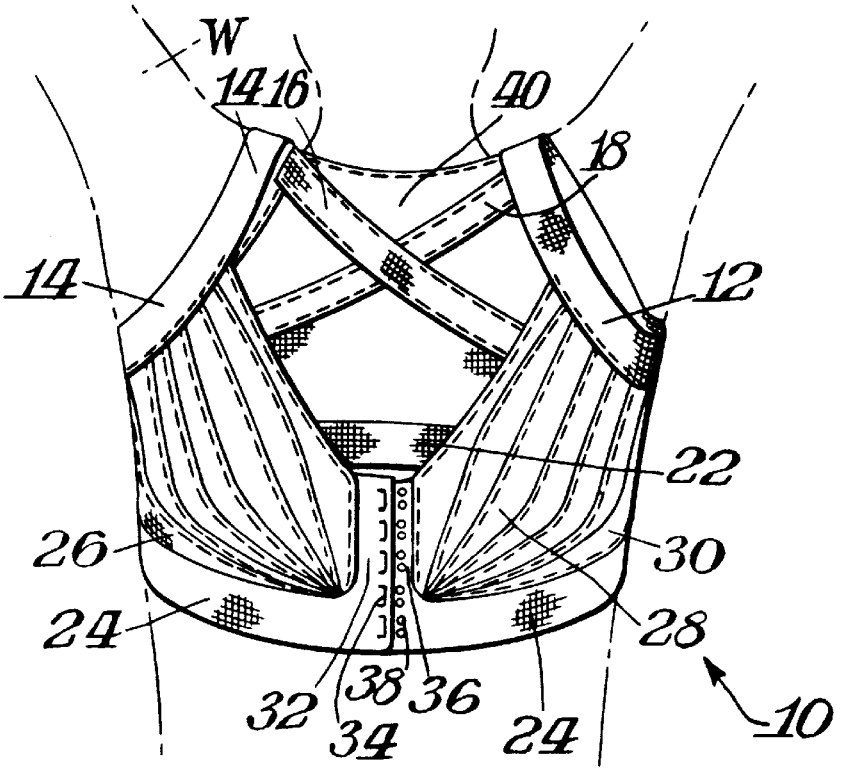
FIG. 2 shows a front elevational view of the bra sport top of FIG. 1. The wearer is shown in phantom.

Referring now to FIG. 2, the front of the bra sport top 10 of the present invention is shown with the over-shoulder harnesses 12, 14 and the cross braces 16, 18 portrayed to the rear of the figure.

Intermediating the space between the over-shoulder harnesses 12, 14 and the slip sleeve 24 are two breast-tensioning panels 26, 28. The right breast-tensioning panel traverses the distance over the wearer's W right breast between the right over-shoulder harness 14 and the slip sleeve panel 24. The same is similarly true for the left breast-tensioning panel 28. The left breast-tensioning panel traverses the distance over the wearer's W left breast between the left over-shoulder harness 12 and the slip sleeve 24.

As shown in FIG. 2, each of the breast-tensioning panels is composed of a series of bands, or strips, that are attached to one another so as to provide directional support for the underlying breast. As shown in FIG. 2, the strips are centered upon points generally adjacent the sternum of the wearer W.

Also as shown in FIG. 2, detachable coupling means are present that provide detachable attachment of the left and right breast-restraining panels 26, 28. One half of the detachable coupling means 32 may have buttonholes, loops, eyes, or the like 34. The other half of the detachable coupling means 36 may have a series of buttons, hooks, or posts 38 that snugly fit in the buttonholes 34 in order to detachably attach, for example, the left 36 and right 32 halves of the detachable coupling means and the bra sport top 10 as a whole. By means of the detachable coupling means, the wearer W may more easily don the bra sport top 10.

In order to provide a more comfortable or cosmetically attractive bra sport top 10, foundation material 40 may be used to cover the structures of the bra sport top 10 or may underlie the same. The foundation material 40 provides a cover for the woman's upper torso and can serve to either overlie and cover the supporting structures of the bra sport top or may serve as a cushion intermediating the contact between such structures and the wearer W. If the foundation material 10 overlies the supporting structures, it may be fashioned so as to have a pleasing external appearance in the colors and styles currently of fashion.

Figure 3:
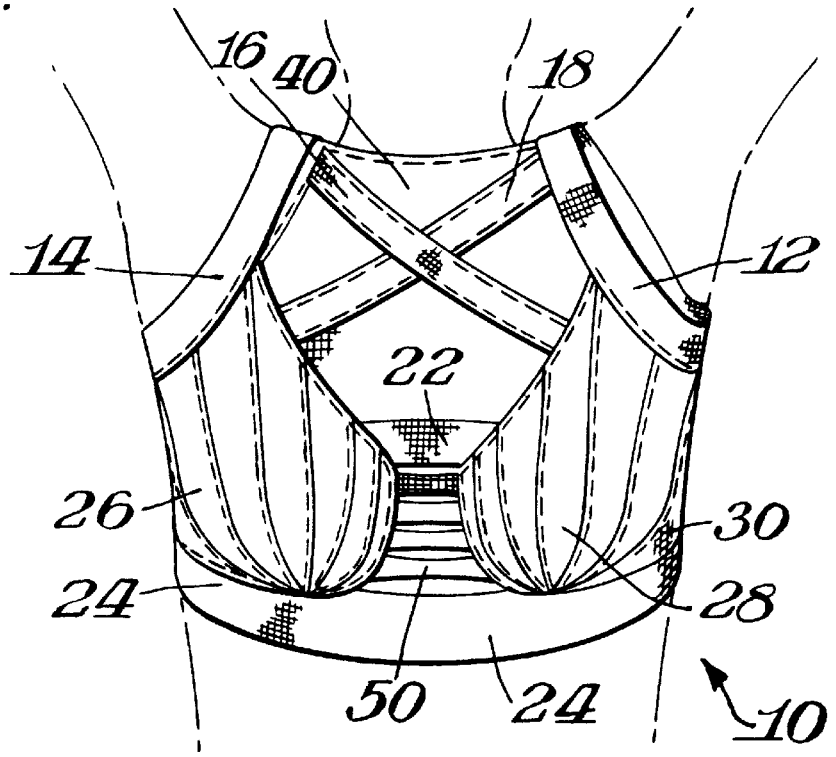
FIG. 3 shows a front elevational view of a second embodiment of the bra sport top of the present invention. The wearer is shown in phantom.
Figure 4:
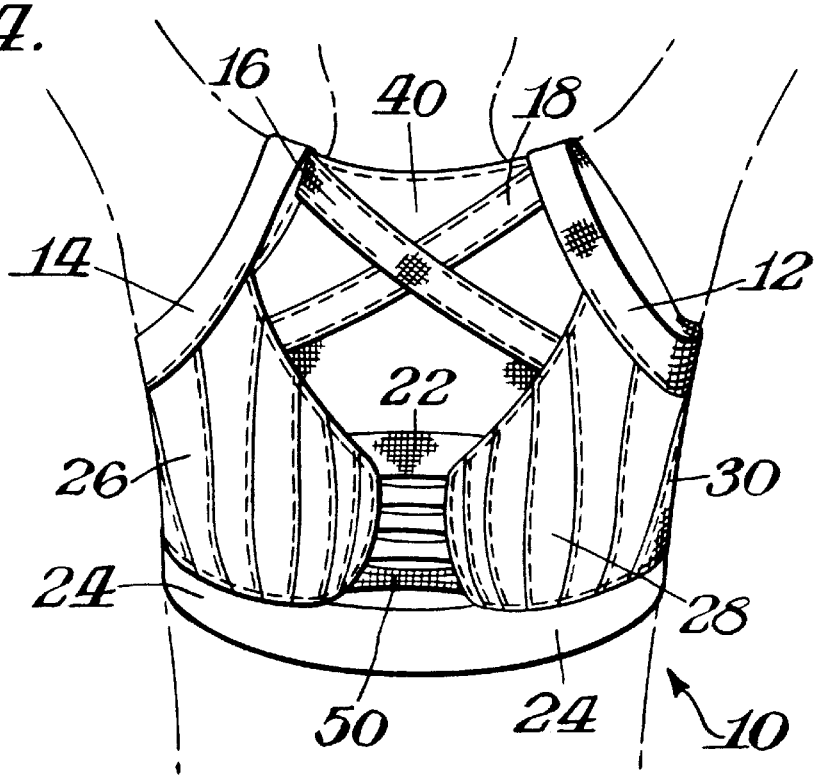
FIG. 4 shows a front elevational view of an additional embodiment of the present invention. The wearer is shown in phantom.

FIGS. 3 and 4 show two alternative embodiments of the present invention. Reference is made to similar structures by using similar reference numbers.

Referring now to FIG. 3, the bra sport top 10 has individual breast-tensioning panels 30 centered upon points immediately below each breast. The right breast-tensioning panel has its panels emanating from a point immediately below the right breast with the same being similarly true for the left breast-tensioning panel 28. Elastic bands or the like 50 interconnect the right and left breast-tensioning panels 26, 28. Such elastic bands 50 allow the wearer to slip the bra sport top on, flexing it wider in order to slip into the bra sport top 10.

In the embodiment shown in FIG. 4, the individual breast-tensioning panels 30 are vertically striated so as to provide directional support to the underlying breasts. As for the embodiment shown in FIG. 3, the vertically striated embodiment of FIG. 4 has a unitary slip sleeve without any detachable attachment means between the right and left breast-tensioning panels 26, 28. The absence of the detachable coupling means is achieved by use of the elastic bands 50 and allows the slip sleeve 24 to entirely traverse the front portion of the bra sport top 10. The support belt 22 similarly encircles the entire upper torso just below the breasts, traveling entirely through the slip sleeve 24.

Construction of the bra sport top 10 is generally achievable by means currently known in the art for the stitching and sewing of athletic apparel. The fabrics and materials of which the bra sport top 10 is constructed are known to those familiar with the art. Generally, those structures of the bra sport top serving to establish or enhance support should be made of materials of sufficient strength to achieve such support. With respect to the right and left breast-tensioning panels 26, 28, these should be fabricated so that the breasts are not overly compressed to the point of discomfort but instead provide as much support as possible without interfering with the athletic activities of the wearer W. Generally, the entire bra sport top may be made of elastic materials. Materials having greater elasticity should be used for the breast-tensioning panels 26, 28. Materials of lesser flexibility may be used for the remaining structures of the bra sport top 10. As it is the support belt 22 which serves to attach the lower portion of the bra sport top 10 to the wearer W, the slip sleeve 24 may be made of the least flexible or even non-flexible material so as to provide a more rigid support.

While the present invention has been described with regards to particular embodiments, it is recognized that additional variations of the present invention may be devised without departing from the inventive concept.

What I claim is:

1. A sport top for a woman that supports the woman's breasts and enhances her posture comprising an over-shoulder harness in the form of a pair of spaced straps located at a back of said top and extending over the shoulders to a front of said top, at least one cross-brace tension strap at said back of said top, said tension strap being connected to said harness straps, breast-tensioning and support panels at said front of said top, said panels comprising a right panel for being over the right breast and a left panel for being over the left breast, each of said panels having an upper end and a lower end, each of said panels comprising a plurality of elastic bands longitudinally secured together, said bands extending upwardly from said lower end at a location below the breast, said panel having a length and width for covering the breast, said panels being connected together at a location between the breasts, said upper end of each of said panels being secured to a respective one of harness straps at said front of said top, and said lower straps ends of said panels being secured to a support belt.

2. The sport top for a woman according to claim 1, wherein said bands of material radially emanate from a point generally centered on the woman's sternum.

3. The sport top for a woman according to claim 1, wherein said bands of material are vertically striated.

4. The sport top for a woman according to claim 1, wherein said bands of material radially emanate from a point below each breast.

5. The sport top for a woman according to claim 1, further comprising:

foundation material, said foundation material providing a covering for the sport top, and said foundation material attached to said over-shoulder harness and said support belt.

6. The sport top for a woman according to claim 1, further comprising: detachable attachment structure for detachable coupling a right portion of said breast-tensioning panels to a left portion of said breast-tensioning panels, a first halt of said detachable attachment structure coupled to said right portion of said breast-tensioning panels and a second half of said detachable attachment structure coupled to said left portion of said breast-tensioning panels, said first half detachably attaching to said second half whereby said right portion of said breast-tensioning panels is detachably attached to said left portion of said breast-tensioning panels.

7. The sport top for a woman according to claim 6, wherein said detachable attachment structure comprises a system of hooks and eyes elastically coupled to said breast-tensioning panels.

8. The sport top for a woman according to claim 1, wherein said at least one cross-brace tension strap comprises to two tension straps cross each other to form an X, and each of said tension straps being connected at one end to one of said harness straps and at its other end to the other of said harness straps.

9. The sport top for a woman according to claim 8, further comprising:

adjustment structure for adjusting tension of said cross-brace tension straps, said adjustment structure coupled to said cross-brace tension straps.

10. The sport top for a woman according to claim 9, wherein said adjustment means further comprises:

adjustable belts providing selectable adjustment for said tension of said cross-brace tension straps.

11. The sport top for a woman according to claim 10, wherein said adjustable belts further comprise hooks and eyes.

12. A sport top for a woman that supports the woman's breasts and enhances her posture, comprising: over-shoulder harness means extending over a front and a back of said top for harnessing the woman's shoulders; cross-brace tension means coupled to said over-shoulder harness means at said back of said top; breast-tensioning means coupled to said over-shoulder harness means at said front of said top; support-belt means coupled to said breast-tensioning means; and slip sleeve means for providing a slideable connection between said support-belt means and said breast-tensioning, means and, said slip-sleeve means coupled to said support belt means and said breast-tensioning means.

13. The sport top for a woman according to claim 12, wherein said slip sleeve members further comprise:

material formed into a loop through which said support-belt may slide, said loop traversing along a lower portion of said breast-tensioning panels.

14. A sport top for a woman that supports the woman's breasts and enhances her posture, comprising:

left and right over-shoulder harnesses for fitting over and under respective left and right shoulders of the woman, a first cross brace, said first cross brace attached to a first end to a top portion of said left over-shoulder harness and at a second end to a bottom portion of said right over-shoulder harness, a second cross brace, said second cross brace attached at a first end to a top portion of said right over-shoulder harness and at a second end to a bottom portion of said left over-shoulder harness, a support belt, said support belt coupled to said over-shoulder harnesses by a slip sleeve.

15. The sport top for a woman according to claim 14, further comprising:

left and right breast restraints coupled respectively to said left and right over-shoulder harnesses and coupled to said support belt.

16. The sport top for a woman according to claim 14, wherein said slip sleeve further comprises:

material formed into a loop through which said support belt may slide, said loop traversing along a lower portion of said left and right breast restraints.

17. The sport top for a woman according to claim 14, wherein said first and second cross braces are adjustable.

18. A sport top for a woman that supports the woman's breasts and enhances her posture, comprising:

over-shoulder harness means cross-brace tension means, said cross-brace tension means coupled to said over-shoulder harness means;

left and right breast-restraining means, said breast-restraining means coupled to said over-shoulder harnesses and a support belt, each of said left and right breast-restraining means comprising bands of material;

said support-belt means coupled to said breast-restraining means;

slip-sleeve means for providing a slideable connection between said support-belt means and said breast-tensioning means, said slip-sleeve means coupled to said support-belt means and said breast-tensioning means and comprising material formed into a loop through which said support-belt means may slide, said loop traversing along a lower portion of said breast-restraining means;

foundation material, said foundation material providing a covering for the sport top, said foundation material attached to said over-shoulder harnesses and said support belt;

adjustment means for adjusting tension of said cross-brace tension means, said adjustment coupled to said cross-brace tension means and comprising adjustable hooks and eyes; and a hook-and-eye system elastically coupled to said left and right breast-restraining means, said hook-and-eye system providing detachable attachment of said right breast-restraining means with said left breast-restraining means.

* * * * *